United States Patent [19]

Speer

[11] Patent Number: 4,702,149

[45] Date of Patent: Oct. 27, 1987

[54] PASSIVE DEHUMIDIFICATION OF ATTIC AND CRAWL SPACE OF BUILDINGS

[76] Inventor: William D. Speer, 319 Lisa La., Gallatin, Tenn. 37066

[21] Appl. No.: 4,889

[22] Filed: Jan. 20, 1987

[51] Int. Cl.[4] ..... F24F 7/02

[52] U.S. Cl. ..... 98/37; 98/DIG. 6; 52/95

[58] Field of Search ..... 98/37, DIG. 6; 52/95

[56] References Cited

U.S. PATENT DOCUMENTS

| | | | |
|---|---|---|---|
| 3,125,941 | 3/1964 | Grout et al. | 98/18 |
| 3,125,942 | 3/1964 | Smith | 98/37 |
| 3,413,905 | 12/1968 | Johnson | 98/37 |
| 3,686,802 | 8/1972 | Sietmann | 52/15 |
| 4,159,673 | 7/1979 | Weirech | 98/37 |
| 4,214,510 | 7/1980 | Ward | 98/37 |
| 4,222,315 | 9/1980 | Weirech | 98/37 |
| 4,269,007 | 5/1981 | Ward | 52/92 |

FOREIGN PATENT DOCUMENTS

| | | | |
|---|---|---|---|
| 142435 | 9/1982 | Japan | 98/DIG. 6 |

*Primary Examiner*—Albert J. Makay
*Assistant Examiner*—David W. Westphal
*Attorney, Agent, or Firm*—Pitts and Brittian

[57] ABSTRACT

Passive dehumidification ventilator for crawl spaces and attics of dwellings. According to the present invention, dehumidification is accomplished for the attics and crawl spaces of dwellings by providing entrance tubes for circulating air in these regions. The tubes are constructed such that cooler incoming air through the center of the tubes causes condensation on exterior surfaces of moisture that is contained in the air of an attic or crawl space. This moisture is then conveyed exterior to the building so that it is not reintrained in the air flow. Since moisture is reduced by condensation, a lower air flow is required to reduce the moisture content, and thus the heat load of the heating system is reduced thereby. In a soffit unit, a plurality of tubes direct air into the region adjacent the roof structure such that moisture ladened air flowing down the inner surface of the roof condenses the moisture therefrom on the exterior of the tubes. This condensed moisture is collected in a pan and a drain trap is used to prevent reverse air flow there. A similar structure having a single tube is utilized for the crawl space; however, no drain trap is necessitated because of the low velocity flow in this region of the dwelling. Also described is a damper system which can be used for tubes in an attic unit to give necessary control of the air flow to accomplish desired results in a specific installation.

14 Claims, 9 Drawing Figures

PASSIVE DEHUMIDIFICATION OF ATTIC AND CRAWL SPACE OF BUILDINGS

DESCRIPTION

1. Technical Field

This invention relates generally to the ventilation of attic and crawl spaces of buildings and similar unheated portions, and more particularly to a device for limiting the air changes in these spaces while providing dehumidification therein.

2. Background of the Invention

Most building structures, and in particular residences and the like, generate a considerable amount of moisture within the living space. Typical sources of moisture are, for example, the laundry, baths, kitchen, and just general utilization of the space. During winter months, in particular, this moisture flows through miscellaneous openings into the attic space and into the crawl space, and increased moisture in these areas increases the heat loss from living portions into the unoccupied and unheated portions of the building. In order to prevent a build up of this moisture, it is well recognized that these unoccupied portions of the building must be ventilated, and this is normally accomplished with soffit vents, gable vents, crawl space vents, etc. A problem that often exists, however, is that the quantity of air that must be passed through these regions, normally called the number of air changes, is relatively high for the removal of moisture. This too creates a loss of heat from the living space, and adds significantly to the heating requirements.

Numerous devices have been developed to regulate the flow of air into the attic of buildings. One such device is illustrated in U.S. Pat. No. 4,159,673, issued to J. F. Weirich on July 3, 1979. This particular device is a "vent block" to be inserted between rafters of a structure with tubes leading therefrom to a volume above the insulation of the building. Specifically this permits the blowing or other type of insertion of the insulation such that it is limited to the area heated, but does not interfer then with the passage of vented air from a soffit area to the volume above the insulation.

Other devices which perform a similar function in delineating the air flow, but permitting maximum utilization of insulation, are shown in U.S. Pat. No. 4,214,510, issued to B. K. Ward on July 29, 1980; and U.S. Pat. No. 4,269,007, issued also to Ward on May 26, 1981. Neither of these patents, nor the previously cited '673 patent, deal with any aspect of reducing the number of air changes and yet accomplishing dehumidification of the air.

Shown in U.S. Pat. No. 3,686,802, issued to D. H. Sietmann on Aug. 29, 1972, is a construction for grain drying bins. In the particular device shown therein, moisture that is driven from the grain during the drying process condenses against the roof of the drying bin and is conveyed by gravity toward the periphery of the bin. An auxillary roof is employed in this construction proximate the outer edges of the bin to convey any moisture that may drop from the roof to the outside of the bin and thus prevent reintroduction of moisture into the drying process.

Several devices are known in the art to prevent the introduction of moisture into various types of enclosures, this moisture occuring within the environment exterior the enclosure. For example, in U.S. Pat. No. 3,125,941, issued to R A. Grout, et al., on Mar. 24, 1964, there is a ventilator for a vehicle which separates incoming moisture such that the moisture does not enter into the vehicle. Also, in U.S. Pat. No. 3,125,942, issued to L. L. Smith on Mar. 24, 1964, there is a soffit ventilator which has a baffle to prevent the introduction of the moisture into the system. Also, in U.S. Pat. No. 3,413,905, issued to E. H. Johnson on Dec. 3, 1968, there is an air intake system having an air/water separator that prevents the introduction of rain into a building. Again, none of these devices is designed to provide for reduced air change in buildings and at the same time remove the moisture from the volume within the attic or crawl space of such buildings.

Accordingly, it is a principal object of the present invention to provide a device for reducing the number of air changes that are required to dehumidify the air in crawl spaces and attics of buildings.

It is an additional object of the present invention to provide a device for reducing the number of air changes to attic and crawl spaces of buildings, which device passively dehumidifies the air in those spaces.

It is also an object of the present invention to provide a device for regulating the air flow into crawl spaces and attics and for dehumidifing the air therein, which device can be retrofit to buildings to reduce the moisture content of air in the attic and crawl spaces of those buildings and thus reduce the heat load for the heating system of those buildings.

Other objects of the present invention will become apparent upon a consideration of the following figures and a description thereof.

SUMMARY OF THE INVENTION

In accordance with the present invention, there is provided a ventilator unit having embodiments suitable for use in the ventilating of crawl spaces and attic spaces of buildings which devices will passively dehumidify the air and thus reduce the number of air changes required and thereby minimize heat losses from the building. More specifically, the invention includes a plurality of tubes fabricated of a relative high thermal conductivity, whereby intake air flowing through these tubes at reduced temperatures causes condensation of moisture on the exterior surface, with this condensed moisture being lead to a collection system for disposal exterior to the building. If desired, these tubes can be provided with a damper system such that the air flow therethrough can be regulated to optimize the flow for various ambient conditions.

DETAILED DESCRIPTION OF THE INVENTION

Figure 1:
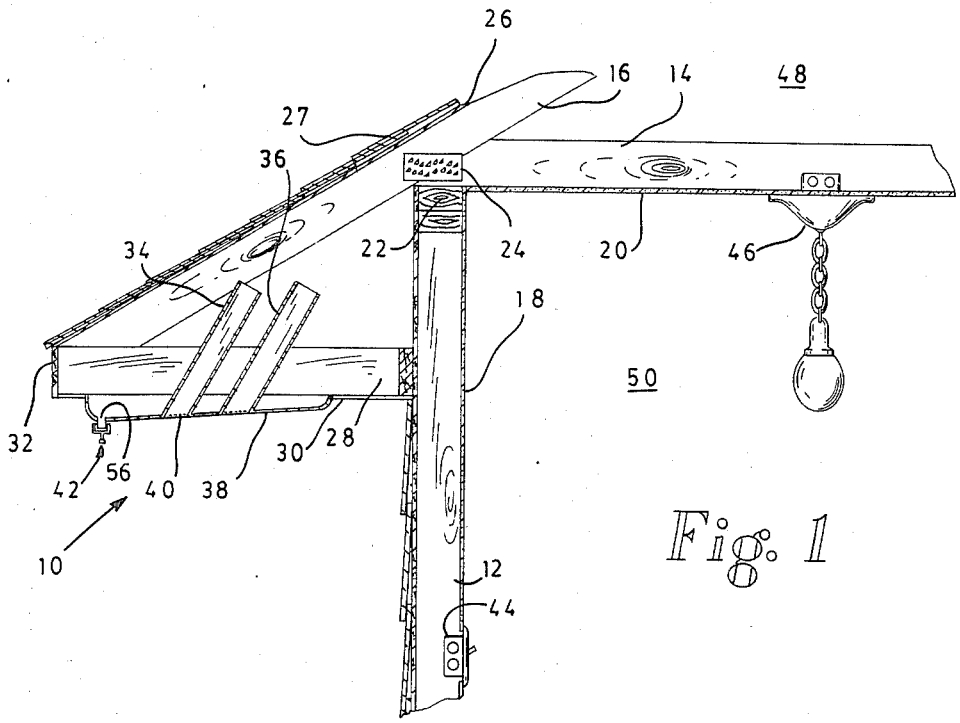
FIG. 1 is a cross-section of a portion of a building illustrating the use of the present invention as a passive attic dehumidification system.

Referring now to FIG. 1, shown therein is a portion of a building of typical construction utilizing a soffit vent 10 according to the present invention. In this particular construction, there is a typical stud wall 12 supporting ceiling joists 14, and in turn, the supporting roof rafters 16. The interior of the wall studs is covered with plaster or sheet rock 18 of typical construction and the ceiling is likewise covered with plaster or sheet rock 20 for typical construction. The ceiling joists 14 rests upon top plate 22 within the wall and are typically fastened to the roof rafter 16 with a nailing plate 24. The roof sheeting 26 is applied to the exterior surface of the rafters 16 in a conventional manner. The sheeting would be covered with shingles or other suitable weather proof surface 27. Joining the exterior end of the roof rafters 16 to the studs 12 are soffit joists 28 which are covered with appropriate soffit material 30 which is plywood, aluminium, vinyl, etc. The exterior end of the soffit joists 28 is enclosed with fascia board 32 and the like to which is normally attached guttering (not shown).

The embodiment of the present invention in the form of a soffit ventilator 10 illustrated in this figure consists of two rows or stacks of tubes 34, 36, angularly inclined with respect to the soffit 30 and the sheeting 26 so as to direct air toward the space between the top plate 22 and the sheeting 26 such that air will continue through the attic toward a ridge vent or gable vent (not shown). These tubes 34, 36 can be of any appropriate cross section; however, an increased surface area can be provided if they are square or rectangular in cross-section. These tubes 34, 36 are fabricated from a material having a high thermal conductivity for reasons set forth hereinafter. Typically, this is metal, e.g. aluminium, galvanized steel, etc. The lower ends of the tubes 34, 36 are joined to a collection pan 38, but communicate with the exterior air, and each tube is provided with an insect-/bird screen 40. The collection pan 38 slopes to and terminates in a drain trap 42 (embodiment shown in FIGS. 3 and 4) located at a low point.

Also shown in FIG. 1 are typical switch box 44 and light fixture 46. It is around these units that moist air typically seeps through the walls and ceiling and ultimately accumulates into attic space 48. This moist air is derived from cooking, use of showers, washing, and similar high moisture producing operations within the building 50. This moist air seeping into and collecting in the attic space 48 increases the heat loss from the heated portion 50 into the attic space 48, and thereby places an additional heat load on the heating system. As the moister air in the attic is cooled by exterior environment, it tends to move down along the sheeting 26 in a direction of the soffit where it becomes intermixed with the air entering through the soffit vents. This causes further cooling of the air and further movement downwardly toward the soffit region.

When the incoming air through the soffit vent unit 10 is colder than the air in the attic space 48, the extended surfaces of the tubes 34, 36 because of their high thermal conductivity provide a condensing surface on the exterior thereof to remove excess moisture from the surrounding air. This moisture tends to flow down the exterior of the tubes and to be collected in the pan 38 and then moved to the drain or drain trap 42 by gravity. Since moisture is removed from the air by condensation, the total air flow through the attic space can be reduced over that required for removal of the moisture in a conventional manner, i.e., strictly air flow through the attic space 48. With this reduced air flow permitted through the use of the passive dehumidification unit 10, there is a further reduction in heat loss and therefore a reduction of the load on the heating system of the dwelling.

Figure 2A:
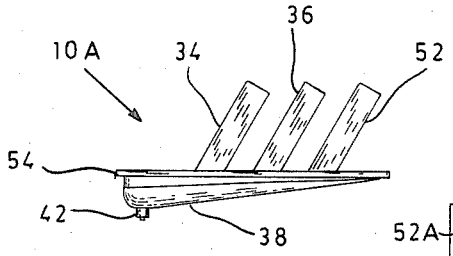
FIG. 2A is a side view of a typical soffit unit for attic dehumidification.
Figure 2B:
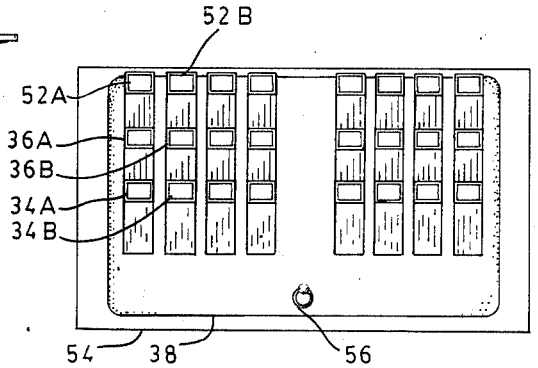
FIG. 2B is a top view of the unit of FIG. 2A.
Figure 2C:
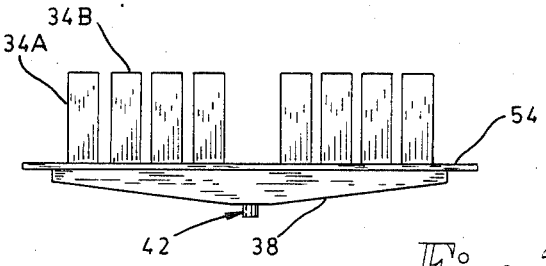
FIG. 2C is a front view of the unit of FIG. 2A.

Referring now to FIG. 2, shown therein is another embodiment 10A of a soffit passive dehumidification unit. This embodiment is similar to that shown in FIG. 1, except that there are three rows or stacks of tubes 34, 36, and 52. In FIG. 2A, it can be seen that these three sets of tubes terminate in the condensation collection pan 38', which is provided with a flange 54 useful in securing the unit in place under the soffit of a dwelling. The top view of this unit is shown in FIG. 2B, wherein it may be seen that a plurality of triple tubes are arranged along the length of the tray 38. For example, there are tubes 34A, 36A, 52A, 34B, 36B, 52B, etc. Disposed in the tray is an opening or aperture 56 which leads to the aforementioned trap 42 such as shown in FIGS. 1, 2A, and 2C. Although this opening is shown centrally located, it could be also disposed at any place along the length of the tray 38 such that it is at the lowest point, and therefore all moisture collecting in tray 38 passes through the opening 56 and into the trap. A front view of this unit is shown in FIG. 2C, again illustrating that there are a number of tubes in each row of the unit.

Figure 3:
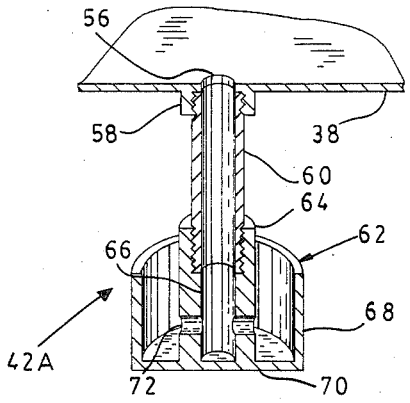
FIG. 3 is one embodiment of a condensate trap for use with the device of FIGS. 1 and 2.

It is desired that the entrance of air into the attic space when the present invention is utilized should be only through the tubes 34, 36, etc. In order that there is no inflow of air through the drain from the tray 38, a type of moisture trap is preferred and one such trap 42A is illustrated in FIG. 3. It can be seen that this embodiment utilizes a collar 58 that surrounds the aperture 56 within the collection pan 38. Threadably engaged with this collar 58 is a nipple 60 to which is threadably attached a cup 62. This cup 62 is fabricated with a riser 64 provided with an axial passageway 66, an upstanding rim 68, and a bottom 70. Radial ports 72 are provided in the riser 64 for communication between the passageway 66 and the volume within the rim 68. Condensation is held within this cup to prevent air flow in a reverse direction into the attic space as set forth above.

Figure 4:
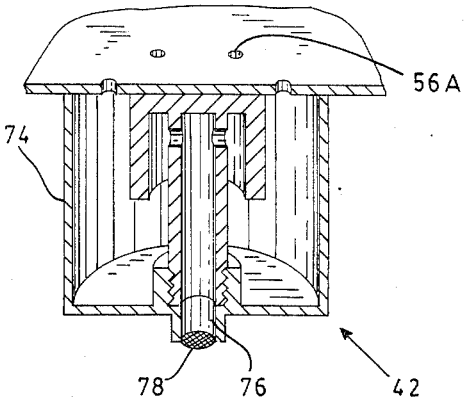
FIG. 4 is an alternate embodiment of a condensate trap for the soffit vent.

Another embodiment of a drain trap of the present invention is illustrated in FIG. 4. This embodiment of the trap, designated 42, corresponds in appearance to the trap shown in FIGS. 1, 2A and 2C. For this embodiment, there can be a plurality of openings 56A arranged in a substantially circular pattern in the base of the tray 38 at the lowest point thereof. These openings communicate with an upright cup 74. As indicated, this trap 42 forms a water seal thereby preventing reverse flow of air through the trap into the attic space. Any excess water exits through the central passageway 76. A screen 78 can cover the outlet from this passageway.

The present invention is also useful in the reduction of moisture content within the crawl space between the floor and the ground under a dwelling. Through the use of this moisture reduction, a reduced rate of air change is provided with an accompanying reduction in heat loss from the dwelling into this crawl space. Such an embodiment is illustrated at 10B in FIGS. 5A and 5B. This shows a typical construction where a crawl space 80 is provided between the ground 82 and the floor joists 84. This particular construction is illustrated for a building veneered with brick 86, having an inside wall 88. Typically heat from the residence is transmitted through the floor 90 into the crawl space 80. This heat transfer is frequently accompanied by additional moisture. In addition, moisture is released from the ground 82 to enter the crawl space. During cold weather, it is desired that moisture in the air of the crawl space be minimized to prevent adverse condensation, and to reduce the heat loss into the volume beneath the floor 90. In this embodiment of the passive dehumidifying vent 10B, tube 92 projects inwardly from a mounting plate 94 such that the tube 92 terminates within the crawl space 80. The tube 92 is perforated along its length as at 93. The inner extremity of tube 92 is mounted within an inclined trough-like member 96 which is preferably protected from the radiant heat from the ground 82 by insulation 98. The lower surface of the trough 96 slopes downwardly toward the exterior wall such that moisture collected thereon is conveyed by gravity to the exterior of the building. As in the embodiments of FIGS. 1 and 2, colder air entering through tube 92 causes the condensation of moisture upon the exterior surface of the tube 92 with this moisture then being conveyed to the trough 96, and the subsequent removal exterior to the building. A baffle 100 is provided on the exterior of the building to prevent entrance of moisture in the exterior air the tube 92. In this embodiment, as in the previously described embodiment, a screen 102 is placed at the entrance to the baffle 100 to prevent the entry by insects, birds and the like. Because air velocity is low in a crawl space ventilation system, a condensate trap is not a necessity to prevent the flow of air through the opening where the condensate exits from the unit as is desired in the soffit embodiment.

Figure 5A:
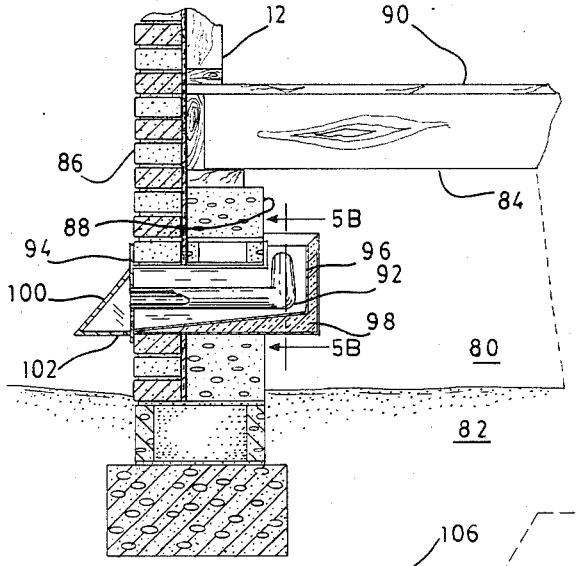
FIG. 5A is a cross-section of a portion of a building illustrating an embodiment of the present invention for use in passive dehumidification of the crawl space of a building.
Figure 5B:
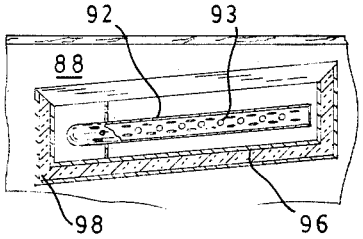
FIG. 5B is a cross-section through 5B—5B of the embodiment in FIG. 5A.

It should be understood that a single unit of the crawl space dehumidifier, such as illustrated in FIGS. 5A and 5B may be insufficient to provide a desired degree of dehumidification. Accordingly, a plurality of such units can be utilized spaced around the structure.

Figure 6:
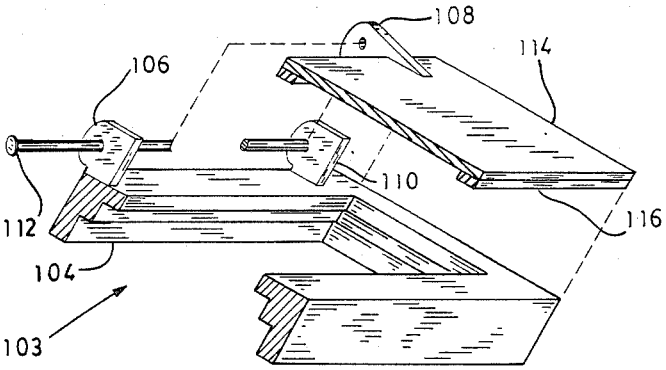
FIG. 6 is a drawing illustrating a typical damper that can be utilized with the soffit vent to regulate the flow of air through the unit such that the air flow can be controlled according to various exterior environmental conditions.

It is anticipated that in a particular installation of the dehumidifing vents, particularly those utilized in the soffit area, it will be desired to be able to adjust the amount of venting for certain environmental conditions. Accordingly, the openings of the vent unit can be divided into any proportion between full venting, shut, or dampered openings, depending upon the circumstances of the installation. The circumstances would include, for example, the solar incidence, the type of upper vent (such as a continuous ridge vent, a turbine vent, or gable end vents), the roof color, moisture load, etc. Accordingly, it is anticipated that it may be desirable to provide means for making this adjustment, with the adjustment being selected after the installation as weather conditions change. This adjustment can be made through a unit such as that shown in FIG. 6. This figure illustrates a type of damper unit 103 for closing of the inner ends of the tubes in the soffit unit. This particular embodiment of a damper unit includes a frame 104 adapted to fit over the end of any of the soffit tubes previously described. Hingedly attached to this frame, as by the hinge portions 106, 108, and 110, and in cooperation with the rod 112, is a tiltable cover 114. This cover 114, which is lifted by mechanical draft as from a gable-end fan, can be provided around its perimeter with a resilient seal 116. This seal 116 provides not only an air seal, but also minimizes the generation of sound as the damper closes. If desired, this damper cover 114 can be counterweighted above the rod 112 center line to adjust the amount of draft needed for opening. It will be apparent that if a circular tube is utilized in the vent units, the damper unit 103 would have a frame to conform to such a configuration.

From the foregoing, it will be understood that a device has been described that will limit the number of air changes per hour necessary to control humidity within the crawl space beneath a residence or like building or in the attic thereof. These units provide passive dehumidification therefore with the reduction in the number of air changes by the incoming air cooling a large surface area without the incoming air interfering with the outgoing moisture and thus re-entering the same. In the case of the soffit unit, the vent provides a cold condensing area at the lowest and coldest area of the attic. The reduction in the number of air changes required in the spaces reduces the temperature differential across the insulation of these areas while controlling the moisture with its benefits of maintaining the established "R" values of the insulation. Thus, heat loss from the heated area of the building is reduced, and the reduction in moisture lessens mold and mildew problems associated with the dwelling.

Although only certain specific embodiments of the present invention have been shown and described herein, the invention is not to be limited by the embodiments. Rather the invention is to be limited only by the appended claims and the equalivents thereof.

I claim:

1. A passive dehumidification vent for use in admitting air to the unheated space of a heated building to reduce the moisture content of such space with reduced air flow, which comprises:

at least one air flow tube having a first end for communication with such space and a further end for communication with the atmosphere exterior to such building, said tube adapted for penetration through an opening leading to such space, said tube fabricated of a high thermal conductivity material;

sealing means attached to said further end of said tube for sealing any space surrounding said tube when said tube is disposed within said opening;

collection means surrounding said tube to collect moisture condensed upon an exterior surface of said tube, said collection means preventing reintrainment of said moisture in air flowing through said tube; and a drain connected to said collection means to convey condensed and collected moisture to a position exterior to such building.

2. The vent of claim 1 wherein said air flow tube comprises a plurality of substantially identical tubes arranged in a preselected array, and each of said plurality of tubes is attached to said sealing means.

3. The vent of claim 2 wherein at least a portion of said plurality of tubes are provided with a damper at said first ends to control the rate of flow of air through said tubes.

4. The vent of claim 1 further comprising a condensate trap connected to said drain whereby condensed moisture in said trap prevents reverse air flow through said drain into said collection means.

5. The vent of claim 1 wherein said seal means and said collection means comprises a pan having a peripheral flange for sealing around said tube when said tube is inserted through a soffit of such building into attic space, said pan having a contour to provide gravity flow to said drain, and further comprises a condensate trap communicating with said drain of said pan whereby condensed moisture in said trap prevents reverse airflow through said drain into said pan and said attic space.

6. The vent of claim 5 wherein said tube comprises a plurality of tubes arranged in a parallel array having further ends of said plurality of tubes attached to said pan and said first ends of said tubes are directed toward said attic space when said vent is installed in said soffit.

7. The vent of claim 6 wherein said array comprises eight tubes in each of three rows.

8. The vent of claim 6 wherein each of said tubes is rectangular in cross-section and each tube and said pan are fabricated from metal.

9. The vent of claim 1 wherein said seal means is a flange surrounding said tube for sealing around said tube when said tube is inserted substantially horizontally through a wall into a crawl space of such building, and said collection means is a trough member surrounding said tube having a first end joined to said flange and a further end, said housing provided with said drain proximate said flange, said trough member having a contour to provide gravity flow of condensed moisture to said drain.

10. The vent of claim 9 wherein said trough member is provided with a layer of thermal insulation on an exterior surface.

11. A passive dehumidification vent for use in admitting air to an unheated attic space of a heated building to reduce the moisture content of such attic space when ambient external air is cooler than such attic space, which comprises:

a plurality of air flow tubes of a high thermal conductivity material arranged in a rectangular array, each of said tubes having a rectangular cross-section and a first end for communication with such attic space and a further end for communication with atmosphere exterior to such building, said tubes to be inserted through a soffit of said building, said soffit provided with an opening therefor;

sealing means attached to and surrounding said further ends of said tubes, said sealing means comprising a pan having a contour to provide gravity flow to substantially a single position in said pan, and a flange surrounding edges of said pan for attachment to said soffit, said pan being provided with a drain opening at said single position; and a condensate trap connected to said pan and communicating with said drain opening to collect condensed moisture in said trap to prevent reverse airflow through said drain opening into such attic space.

12. A passive dehumidification vent for use in admitting air to an unheated crawl space beneath a heated building to reduce moisture content of such crawl space when ambient external air is cooler than such crawl space, which comprises:

an air flow tube of a high thermal conductivity material having a first end for communication with such crawl space and a further end for communication with atmosphere exterior to such building, said tube being inserted through an exterior wall of such crawl space, said wall being provided with an opening therefor;

a sealing flange attached to and surrounding said further end of said tube for attachment to said wall and sealing said opening;

a trough member substantially surrounding said tube having a first end attached to said sealing flange and a further end, said trough member provided with a drain opening proximate said sealing flange communicating with atmosphere exterior such building, said trough member having a contour to provide gravity flow of condensed moisture to said drain opening; and a baffle hood attached to said sealing flange external to such building to prevent precipitation in said atmosphere from entering said tube.

13. The vent of claim 11 further comprising a damper unit covering at least a portion of said first ends of said tubes, said damper unit operated by draft of air flow into such attic space through said tubes.

14. The unit of claim 12 further comprising a layer of exterior insulation on said trough member, and wherein said tube is provided with perforations along its length in such crawl space.

* * * * *